US005988446A

United States Patent [19]

Schitter

[11] Patent Number: 5,988,446

[45] Date of Patent: Nov. 23, 1999

[54] CANDLE MAKING DEVICE

[76] Inventor: Jeffrey W. Schitter, 377 3rd Ave., Jasper, Ind. 47546

[21] Appl. No.: 09/148,046

[22] Filed: Sep. 3, 1998

[51] Int. Cl.[6] ..... B67D 5/62

[52] U.S. Cl. ..... 222/146.5; 222/185.1; 425/122; 141/82; 141/331

[58] Field of Search ..... 222/146.5, 185.1, 222/192, 189.06; 425/122; 141/82, 331

[56] References Cited

U.S. PATENT DOCUMENTS

| | | | |
|---|---|---|---|
| 3,867,173 | 2/1975 | Putzer | 117/39 |
| 3,982,720 | 9/1976 | Inderbiethen | 249/81 |
| 4,291,458 | 9/1981 | Flinn | 29/650 |

*Primary Examiner*—Gregory L. Huson

[57] ABSTRACT

A candle making device for making candles from recycled pieces of old candles. The device includes a funnel with an upper conical portion and a lower drain tube downwardly depending from the upper conical portion. A support structure supports the funnel above a resting surface. A heating element is extended around the upper conical portion of the funnel for melting wax in the upper conical portion. The lower drain tube of the funnel has a valve for selectively opening and closing the lower drain tube. A spool is rotatably mounted to the lower drain tube of the funnel. The spool has a length of flexible candle wick coiled therearound such that a free end of the candle wick downwardly depends from the spool.

12 Claims, 2 Drawing Sheets

CANDLE MAKING DEVICE

BACKGROUND OF THE INVENTION

1. Field of the Invention

The present invention relates to candle making devices and more particularly pertains to a new candle making device for making candles from recycled pieces of old candles.

2. Description of the Prior Art

The use of candle making devices is known in the prior art. More specifically, candle making devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,867,173; U.S. Pat. No. 4,296,064; U.S. Pat. No. 5,636,922; U.S. Pat. No. Des. 118,723; U.S. Pat. No. 2,006,876; and U.S. Pat. No. 5,693,277.

While these devices fulfill their respective, particular objectives and requirements, the aforementioned patents do not disclose a new candle making device. The inventive device includes a funnel with an upper conical portion and a lower drain tube downwardly depending from the upper conical portion. A support structure supports the funnel above a resting surface. A heating element is extended around the upper conical portion of the funnel for melting wax in the upper conical portion. The lower drain tube of the funnel has a valve for selectively opening and closing the lower drain tube. A spool is rotatably mounted to the lower drain tube of the funnel. The spool has a length of flexible candle wick coiled therearound such that a free end of the candle wick downwardly depends from the spool.

In these respects, the candle making device according to the present invention substantially departs from the conventional concepts and designs of the prior art, and in so doing provides an apparatus primarily developed for the purpose of making candles from recycled pieces of old candles.

SUMMARY OF THE INVENTION

In view of the foregoing disadvantages inherent in the known types of candle making devices now present in the prior art, the present invention provides a new candle making device construction wherein the same can be utilized for making candles from recycled pieces of old candles.

The general purpose of the present invention, which will be described subsequently in greater detail, is to provide a new candle making device apparatus and method which has many of the advantages of the candle making devices mentioned heretofore and many novel features that result in a new candle making device which is not anticipated, rendered obvious, suggested, or even implied by any of the prior art candle making devices, either alone or in any combination thereof.

To attain this, the present invention generally comprises a funnel with an upper conical portion and a lower drain tube downwardly depending from the upper conical portion. A support structure supports the funnel above a resting surface. A heating element is extended around the upper conical portion of the funnel for melting wax in the upper conical portion. The lower drain tube of the funnel has a valve for selectively opening and closing the lower drain tube. A spool is rotatably mounted to the lower drain tube of the funnel. The spool has a length of flexible candle wick coiled therearound such that a free end of the candle wick downwardly depends from the spool.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new candle making device apparatus and method which has many of the advantages of the candle making devices mentioned heretofore and many novel features that result in a new candle making device which is not anticipated, rendered obvious, suggested, or even implied by any of the prior art candle making devices, either alone or in any combination thereof.

It is another object of the present invention to provide a new candle making device which may be easily and efficiently manufactured and marketed.

It is a further object of the present invention to provide a new candle making device which is of a durable and reliable construction.

An even further object of the present invention is to provide a new candle making device which is susceptible of a low cost of manufacture with regard to both materials and labor, and which accordingly is then susceptible of low prices of sale to the consuming public, thereby making such candle making device economically available to the buying public.

Still yet another object of the present invention is to provide a new candle making device which provides in the apparatuses and methods of the prior art some of the advantages thereof, while simultaneously overcoming some of the disadvantages normally associated therewith.

Still another object of the present invention is to provide a new candle making device for making candles from recycled pieces of old candles.

Yet another object of the present invention is to provide a new candle making device which includes a funnel with an upper conical portion and a lower drain tube downwardly depending from the upper conical portion. A support structure supports the funnel above a resting surface. A heating element is extended around the upper conical portion of the funnel for melting wax in the upper conical portion. The lower drain tube of the funnel has a valve for selectively opening and closing the lower drain tube. A spool is rotatably mounted to the lower drain tube of the funnel. The spool has a length of flexible candle wick coiled therearound such that a free end of the candle wick downwardly depends from the spool.

Still yet another object of the present invention is to provide a new candle making device that lets a user turn left over stubs of wax candles into new candles.

Even still another object of the present invention is to provide a new candle making device that may be used with new candle wax to form candles as well.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
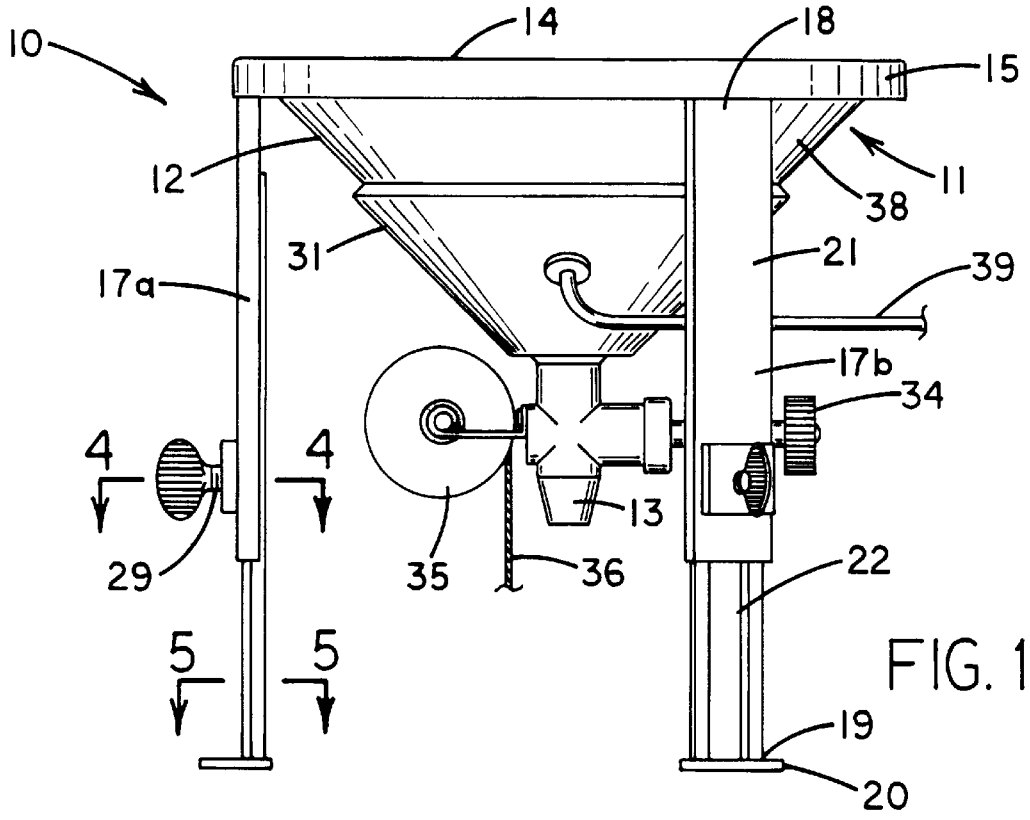
FIG. 1 is a schematic side view of a new candle making device according to the present invention.
Figure 2:
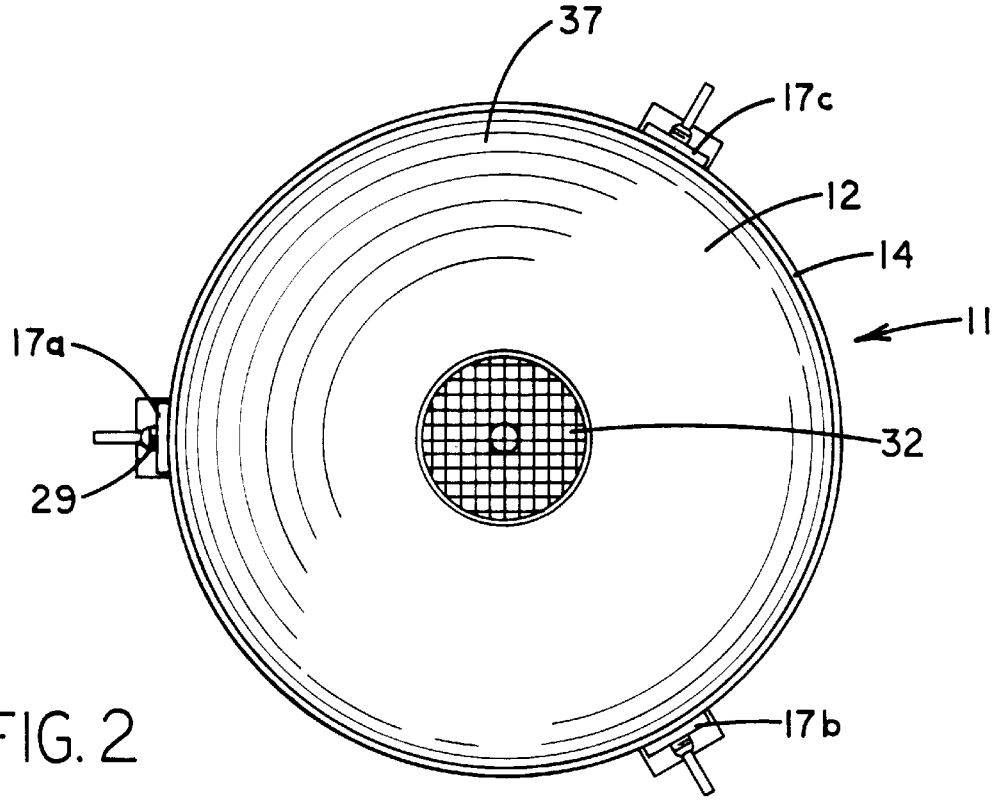
FIG. 2 is a schematic top view of the present invention.
Figure 3:
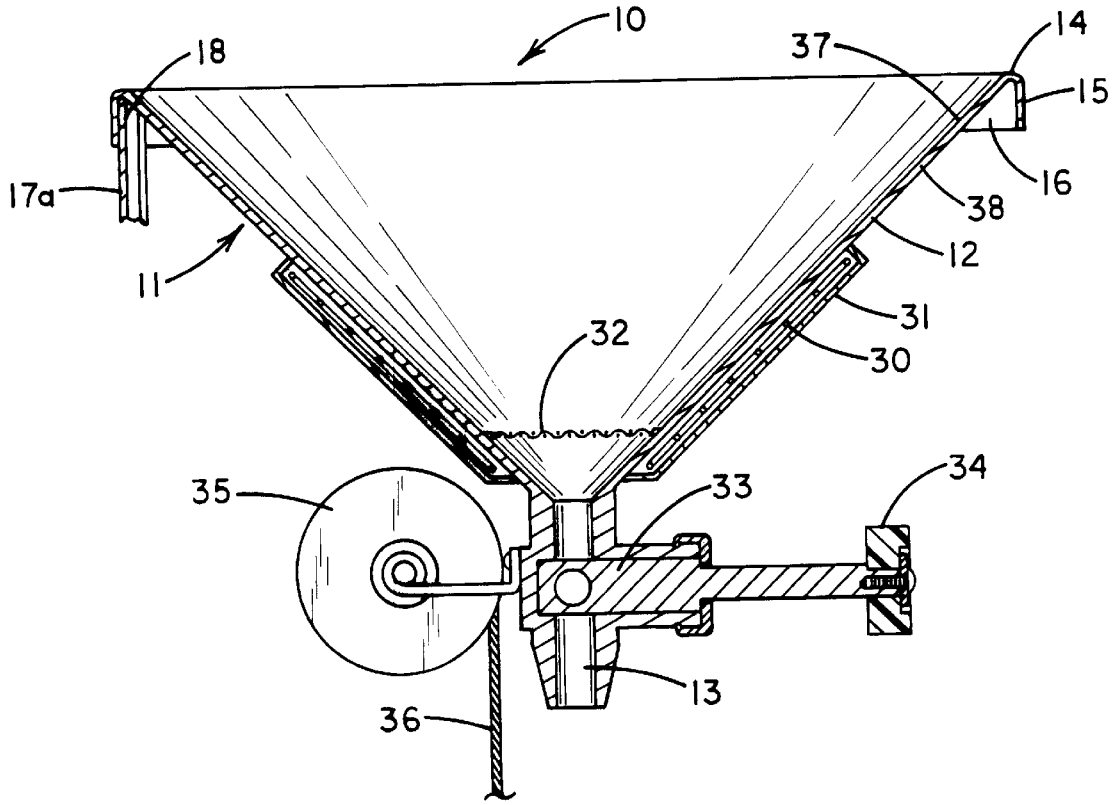
FIG. 3 is a schematic cross sectional view of the funnel region of the present invention.

With reference now to the drawings, and in particular to FIGS. 1 through 5 thereof, a new candle making device embodying the principles and concepts of the present invention and generally designated by the reference numeral 10 will be described.

As best illustrated in FIGS. 1 through 5, the candle making device 10 generally comprises a funnel 11 with an upper conical portion 12 and a lower drain tube 13 downwardly depending from the upper conical portion 12. A support structure 17*a*,17*b*,17*c* supports the funnel 11 above a resting surface. A heating element 30 is extended around the upper conical portion 12 of the funnel 11 for melting wax in the upper conical portion 12. The lower drain tube 13 of the funnel 11 has a valve 33 for selectively opening and closing the lower drain tube 13. A spool 35 is rotatably mounted to the lower drain tube 13 of the funnel 11. The spool 35 has a length of flexible candle wick 36 coiled therearound such that a free end of the candle wick 36 downwardly depends from the spool 35.

In closer detail, the funnel 11 has interior and exterior surfaces 37,38, a generally upper conical portion 12 and a lower drain tube 13 downwardly depending from the vertex of the upper conical portion 12 of the funnel 11. The upper conical portion 12 of funnel 11 has an annular upper edge 14 therearound. In an ideal illustrative embodiment, the upper edge 14 of the upper conical portion 12 has a diameter of about 10 inches. The upper edge 14 of the upper conical portion 12 has a downwardly depending annular lip 15 therearound. The annular lip 15 of upper conical portion 12 preferably has a transverse cross section generally lying in a vertical plane. The annular lip 15 of the upper edge 14 of the upper conical portion 12 and the exterior surface 38 of the upper conical portion 12 defining an annular inverted channel 16 therebetween. In use, the lip and inverted channel let a user extend their fingers underneath the lip and into the inverted channel to provide a better grip when lifting the device 10.

The funnel 11 has a support structure for supporting the funnel 11 above a resting surface. The support structure comprises a plurality of legs 17*a*,17*b*,17*c* downwardly depending from the upper conical portion 12 of the funnel 11. Ideally, there are three legs 17*a*,17*b*,17*c* spaced apart around a circumference of the upper edge 14 of the upper conical portion 12 of the funnel 11 at generally equal intervals. Each of the legs 17*a*,17*b*,17*c* has opposite top and bottom ends 18,19 and a longitudinal axis extending between the top and bottom ends 18,19. The longitudinal axes of the legs 17*a*,17*b*,17*c* are preferably extended generally vertically with respect to the resting surface.

The top ends 18 of the legs 17*a*,17*b*,17*c* are extended into the inverted channel 16 and are coupled to the funnel 11 adjacent the upper edge 14 of the upper conical portion 12. The bottom ends 19 of the legs 17*a*,17*b*,17*c* preferably each terminate at a generally rectangular foot 20. The feet 20 of the bottom ends 19 of the legs 17*a*,17*b*,17*c* generally lie in a horizontal plane with respect to the resting surface generally perpendicular to the longitudinal axes of the legs 17*a*,17*b*,17*c* . In use, the feet 20 are designed for providing additional stability to the support structure when on the resting surface.

Preferably, each of the legs 17*a*,17*b*,17*c* is telescopically extendible along the longitudinal axis of the respective leg to permit lengthening and shortening of the lengths of the legs 17*a*,17*b*,17*c* to adjust the height of the funnel 11 above the resting surface. In this preferred embodiment, each of the legs 17*a*,17*b*,17*c* ideally has upper and lower telescopic portions 21,22 with the upper telescopic portion 21 receiving the lower telescopic portion 22. The upper telescopic portion 21 of each of the legs 17*a*,17*b*,17*c* ideally has a generally rectangular C-shaped transverse cross section taken generally perpendicular to the longitudinal axis of the respective leg so that the upper telescopic portion 21 has a pair of opposing arm regions 23,24 spaced apart from a connecting region 25 connecting the arm regions 23,24 together. The arm region and the connecting region 25 define an elongate channel along a length of the upper telescopic portion 21. The lower telescopic portion 22 of each of the legs 17*a*,17*b*,17*c* has a transverse cross section taken generally perpendicular to the longitudinal axis of the respective leg. The lower telescopic portion 22 has a center region 26 and a pair of opposite side regions 27,28 outwardly extending from the center region 26. The side region of the lower telescopic portion 22 are extended into the elongate channel of the upper telescopic portion 21 to hold the lower telescopic region to the upper telescopic region to permit sliding of the lower telescopic region in the elongate channel of the upper telescopic region along the longitudinal axis of the respective leg.

Figure 4:
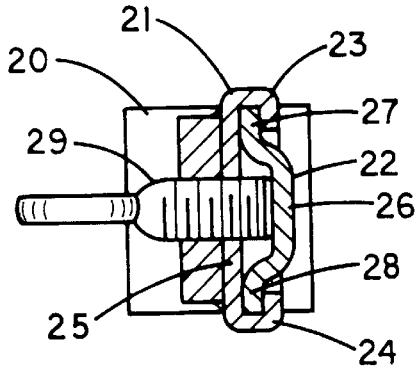
FIG. 4 is a schematic cross sectional view of a leg of the present invention taken from line 4—4 of FIG. 1.
Figure 5:
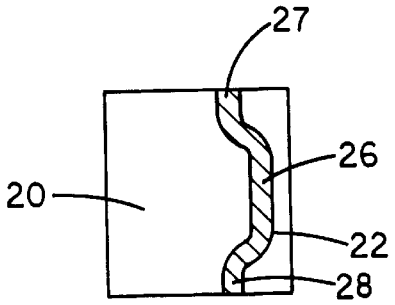
FIG. 5 is a schematic cross sectional view of a leg of the present invention taken from line 5—5 of FIG. 1.

With reference to FIG. 4, each of legs 17*a*,17*b*,17*c* preferably has a threaded fastener 29 threadably extending into the upper telescopic portion 21 through the connecting region 25 and abuts the center region 26 of the lower telescopic portion 22 to releasably hold the lower telescopic portion 22 in a fixed position with respect to the upper telescopic portion 21. Ideally, each of the threaded fasteners 29 has a thumb head designed for permitting rotating of the threaded fastener 29 with the fingers of a user.

In use, the upper conical portion 12 of the funnel 11 is designed for holding candle wax therein (including old candles remnants and new wax pieces). An electrical heating element 30 is extended around the exterior surface 38 of the upper conical portion 12 of the funnel 11. In use, the heating element 30 is designed for providing sufficient heat to melt the wax in the upper conical portion 12. The heating element 30 is preferably positioned on the upper conical portion 12 towards the lower drain tube 13 of the funnel 11 to help ensure that wax located at the bottom of the upper conical portion is melted to pass into the lower tube portion. Ideally, the heating element 30 is electrically connectable to an electric power source by a flexible electrical power cord 39 extending therefrom. In a preferred embodiment, a generally frusto-conical protective housing 31 is extended around the exterior surface 38 of the upper conical portion 12 of the funnel 11 to substantially enclose the heating element 30 therein to protect a user from injury from direct contact with the heating element.

A screen 32 is preferably provided in the upper conical portion 12 of the funnel 11. The screen 32 extends substantially across the upper conical portion 12 and is positioned in the upper conical portion 12 towards the lower drain tube 13 of the funnel 11. The screen 32 has a plurality of apertures of a predetermined size to prevent pieces of non-melted wax larger than the predetermined size from passing therethrough into the lower drain tube 13. Ideally, the screen 32 comprises a mesh screen 32 material.

In use, the lower drain tube 13 is designed for pouring melted wax from the funnel into a mold positioned beneath the lower drain tube 13. The lower drain tube 13 of the funnel 11 has a valve 33 for selectively opening and closing passage of fluid melted wax through the lower drain tube 13. Preferably, the valve 33 has a turn knob 34 outwardly extending therefrom for permitting a user to open and close the valve 33 by the turning the turn knob 34.

A spool 35 is rotatably mounted to the lower drain tube 13 of the funnel 11. The spool 35 has a length of flexible candle wick 36 coiled therearound such that a free end of the candle wick 36 downwardly depends from the spool 35. In use, the candle wick 36 is designed for extending into the candle mold beneath the lower drain tube 13 so that the candle formed in the mold has a wick In use, a user places solid wax into the upper conical portion of the funnel and places a mold underneath the lower drain tube. The wax is melted by the heating element and flows through the lower drain tube when the valve is opened into the mold. The screen prevents debris and chucks of solid wax from passing into the lower drain tube and clogging the lower drain tube. The free end of the candle wick on the spool is extended into the mold so that the melted wax in the mold can solidify around the wick.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for melting wax for forming candles, comprising:

a funnel having an upper conical portion and a lower drain tube downwardly depending from said upper conical portion of said funnel;

said funnel having a support structure for supporting said funnel above a resting surface;

a heating element being extended around said upper conical portion of said funnel;

said lower drain tube of said funnel having a valve for selectively opening and closing said lower drain tube; and a spool being rotatably mounted to said lower drain tube of said funnel, said spool having a length of flexible candle wick coiled therearound such that a free end of said candle wick downwardly depends from said spool.

2. The device of claim 1, wherein said support structure comprises a plurality of legs downwardly depending from said upper conical portion of said funnel.

3. The device of claim 2, wherein each of said legs having opposite top and bottom ends and a longitudinal axis extending between said top and bottom ends, wherein said upper conical portion of funnel has an annular upper edge therearound, wherein said upper edge of said upper conical portion has a downwardly depending annular lip therearound, said annular lip of said upper edge of said upper conical portion defining an annular inverted channel, and wherein said top ends of said legs are extended into said inverted channel and said top ends of said legs are coupled to said funnel adjacent said upper edge of said upper conical portion.

4. The device of claim 3, wherein said longitudinal axes of said legs are extended generally vertically.

5. The device of claim 3, wherein said annular lip of upper conical portion has a transverse cross section generally lying in a vertical plane.

6. The device of claim 2, wherein said plurality of legs comprises three legs, said three legs being spaced apart around a circumference of said upper edge of said upper conical portion of said funnel at generally equal intervals.

7. The device of claim 2, wherein each of said legs is telescopically extendible along a longitudinal axis of the respective leg.

8. The device of claim 7, wherein each of said legs has upper and lower telescopic portions, said upper telescopic portion receiving said lower telescopic portion.

9. The device of claim 8, wherein said upper telescopic portion of each of said legs has a generally rectangular C-shaped transverse cross section and has a pair of opposing arm regions spaced apart from a connecting region connecting said arm regions together, said arm region and said connecting region defining an elongate channel along a length of said upper telescopic portion, said lower telescopic portion of each of said legs has a transverse cross section and has a center region and a pair of opposite side regions outwardly extending from said center region, said side region of said lower telescopic portion being extended into said elongate channel of said upper telescopic portion to hold said lower telescopic region to said upper telescopic region to permit sliding of said lower telescopic region in said elongate channel of said upper telescopic region along said longitudinal axis of the respective leg.

10. The device of claim 9, wherein each of legs has a threaded fastener threadably extending into said upper telescopic portion and abutting said lower telescopic portion to releasably hold said lower telescopic portion in a fixed position with respect to said upper telescopic portion.

11. The device of claim 1, further comprising a screen being provided in said upper conical portion of said funnel, said screen extending substantially across said upper conical portion, said screen being positioned in said upper conical portion towards said lower drain tube of said funnel.

12. A device for melting wax for forming candles, comprising:

a funnel having interior and exterior surfaces, a generally upper conical portion and a lower drain tube downwardly depending from said upper conical portion of said funnel;

said upper conical portion of funnel having an annular upper edge therearound;

said upper edge of said upper conical portion having a downwardly depending annular lip therearound, said annular lip of upper conical portion having a transverse cross section generally lying in a vertical plane;

said annular lip of said upper edge of said upper conical portion and said exterior surface of said upper conical portion defining an annular inverted channel therebetween;

said funnel having a support structure for supporting said funnel above a resting surface, said support structure comprising a plurality of legs downwardly depending from said upper conical portion of said funnel;

wherein said plurality of legs comprises three legs, said three legs being spaced apart around a circumference of said upper edge of said upper conical portion of said funnel at generally equal intervals;

each of said legs having opposite top and bottom ends and a longitudinal axis extending between said top and bottom ends;

said longitudinal axes of said legs being extended generally vertically;

said top ends of said legs being extended into said inverted channel, said top ends of said legs being coupled to said funnel adjacent said upper edge of said upper conical portion;

said bottom ends of said legs each terminating at a foot, said feet of said bottom ends of said legs generally lying in a horizontal plane generally perpendicular to said longitudinal axes of said legs;

each of said legs being telescopically extendible along the longitudinal axis of the respective leg, each of said legs having upper and lower telescopic portions, said upper telescopic portion receiving said lower telescopic portion;

said upper telescopic portion of each of said legs having a generally rectangular C-shaped transverse cross section having a pair of opposing arm regions spaced apart from a connecting region connecting said arm regions together, said arm region and said connecting region defining an elongate channel along a length of said upper telescopic portion;

said lower telescopic portion of each of said legs having a transverse cross section having a center region and a pair of opposite side regions outwardly extending from said center region, said side region of said lower telescopic portion being extended into said elongate channel of said upper telescopic portion to hold said lower telescopic region to said upper telescopic region to permit sliding of said lower telescopic region in said elongate channel of said upper telescopic region along said longitudinal axis of the respective leg;

each of legs having a threaded fastener threadably extending into said upper telescopic portion and abutting said lower telescopic portion to releasably hold said lower telescopic portion in a fixed position with respect to said upper telescopic portion;

said upper conical portion of said funnel being adapted for holding candle wax therein;

a heating element being extended around said exterior surface of said upper conical portion of said funnel;

said heating element being positioned on said upper conical portion towards said lower drain tube of said funnel;

a protective housing being extended around said exterior surface of said upper conical portion of said funnel, said protective housing substantially enclosing said heating element therein;

a screen being provided in said upper conical portion of said funnel, said screen extending substantially across said upper conical portion, said screen being positioned in said upper conical portion towards said lower drain tube of said funnel;

said screen having a plurality of apertures of a predetermined size to prevent pieces of wax larger than said predetermined size from passing therethrough into said lower drain tube, wherein said screen comprises a mesh screen material;

said lower drain tube of said funnel having a valve for selectively opening and closing said lower drain tube; and a spool being rotatably mounted to said lower drain tube of said funnel, said spool having a length of flexible candle wick coiled therearound such that a free end of said candle wick downwardly depends from said spool.

* * * * *